US009909275B2

(12) United States Patent
Burr

(10) Patent No.: US 9,909,275 B2
(45) Date of Patent: Mar. 6, 2018

(54) MANHOLE COVER ASSEMBLY

(71) Applicant: Neenah Foundry Company, Neenah, WI (US)

(72) Inventor: Randy Burr, Neenah, WI (US)

(73) Assignee: Neenah Foundry Company, Neenah, WI (US)

( * ) Notice: Subject to any disclaimer, the term of this patent is extended or adjusted under 35 U.S.C. 154(b) by 0 days.

(21) Appl. No.: 15/268,015

(22) Filed: Sep. 16, 2016

(65) Prior Publication Data

US 2017/0081822 A1 Mar. 23, 2017

Related U.S. Application Data

(60) Provisional application No. 62/219,907, filed on Sep. 17, 2015.

(51) Int. Cl.
*E02D 29/14* (2006.01)

(52) U.S. Cl.
CPC ..... *E02D 29/1427* (2013.01)

(58) Field of Classification Search
USPC ..... 404/25; 52/19, 20
See application file for complete search history.

(56) References Cited

U.S. PATENT DOCUMENTS 3,182,581 A * 5/1965 Von Poederoyen ..... F24F 7/02 454/194
5,465,862 A * 11/1995 Devlin ..... B64F 1/362 16/278
5,533,641 A * 7/1996 Argandona ..... B65D 90/105 220/248
5,950,368 A * 9/1999 Bradford ..... E02D 29/1418 220/484
6,125,508 A * 10/2000 Formenti ..... E05D 5/08 16/278
6,616,370 B1 * 9/2003 Signorelli ..... B65D 90/48 404/25
6,764,261 B1 * 7/2004 Stadler ..... E02D 29/1427 411/340
7,484,908 B2 * 2/2009 Stadler ..... E02D 29/1418 404/25
7,712,995 B2 * 5/2010 Stadler ..... E02D 29/1427 404/25

(Continued)

*Primary Examiner* — Thomas B Will
*Assistant Examiner* — Katherine J Chu
(74) *Attorney, Agent, or Firm* — Foley & Lardner LLP

(57) ABSTRACT

A manhole cover assembly includes a manhole cover supportable by a manhole frame. The manhole cover defines a latch bore having a longitudinal axis. A latch housing extends from the manhole cover, and a latch assembly is positioned at least partially therein. A first end of a latch yoke extends through the latch bore and slidably couples the latch yoke to the manhole cover along the longitudinal axis. A latch member is rotatably coupled to the second end of the latch yoke about a first transverse axis perpendicular to the longitudinal axis. The latch member is also rotatably coupled to the latch housing about a second transverse axis spaced from the first transverse axis. The latch member is selectively rotatable relative to the latch housing about the second transverse axis, between a locked position and an unlocked position, via sliding the latch yoke relative to the manhole cover.

8 Claims, 7 Drawing Sheets

(56) References Cited

U.S. PATENT DOCUMENTS

| | | | | |
|---|---|---|---|---|
| 7,891,904 | B2 * | 2/2011 | Stadler | E02D 29/1427 404/25 |
| 8,784,000 | B2 * | 7/2014 | Reynolds | E02D 29/1436 404/25 |
| 2009/0255183 | A1 * | 10/2009 | Nolle | E02D 29/14 49/57 |
| 2016/0289913 | A1 * | 10/2016 | Canney | E05B 35/008 |

* cited by examiner

MANHOLE COVER ASSEMBLY

CROSS REFERENCE TO RELATED APPLICATIONS

The present application claims the benefit of priority to 62/219,907, filed Sep. 17, 2015 and the contents of which are incorporated herein by reference in its entirety.

TECHNICAL FIELD

The present disclosure relates generally to the field of manhole and hatch cover assemblies.

BACKGROUND

A manhole provides access to an underground passage or confined area. The underground passage or confined area may contain public utility equipment, such as sewer lines, storm drains, electrical and telecommunication cables, etc. A manhole or hatch cover is a removable plate that forms a lid over the opening of a manhole. Manhole covers are used to prevent individuals and objects from falling into the manhole, as well as to prevent unauthorized access into the manhole. The terms "manhole cover" as used herein to mean either a manhole cover, or a hatch cover and the like.

Manhole covers are conventionally formed of cast iron, which makes them inexpensive, strong, and heavy, usually weighing more than 100 pounds. The weight helps to keep them in place when traffic passes over them, and makes it difficult for unauthorized individuals to remove them. In addition to being constructed of cast iron, manhole covers may also be constructed of concrete, glass-reinforced plastic or other composite materials, and other materials, or any combination thereof.

Despite their significant weight, manhole covers can be dislodged in several ways. For example, an explosion within a manhole can cause a sudden pressure buildup that can dislodge the manhole cover. For example, gases (e.g., methane from sewage or natural gas from a leaking natural gas line) can become trapped in the space within the manhole, as well as within the passages or spaces connected to the manhole. The gas may be ignited, for example, due to a spark from a frayed power cable. Some explosions generate sufficient pressure to dislodge the manhole from its frame. However, higher-intensity explosions may propel the manhole cover up to 20 feet or more into the air. A heavy manhole cover flying through the air can be extremely dangerous or deadly. In addition to the human and property damage risk, individuals or objects may subsequently fall into the now-uncovered manhole.

Excessive rainfall and flooding can also dislodge manhole covers. For example, storm drain systems may become overfilled during periods of excessive rainfall. Water may flow through the storm drain systems and up through a manhole. Sufficient pressure from the water may dislodge manhole covers and "float" them away. The now-uncovered manhole can be obscured by dirty water, thereby providing a dangerous risk that an unwary victim may inadvertently fall into the manhole and into the storm drain system.

SUMMARY

Various embodiments relate to manhole cover assemblies. An example manhole cover assembly includes a manhole cover supportable by a manhole frame. The manhole cover defines a latch bore having a longitudinal axis. A latch housing extends from a face of the manhole cover, and is positioned at least partially within the latch housing. A latch yoke has first end and an opposite second end. The first end extends through the latch bore and slidably couples the latch yoke to the manhole cover along the longitudinal axis. A latch member is rotatably coupled to the second end about a first transverse axis perpendicular to the longitudinal axis. The latch member is also rotatably coupled to the latch housing about a second transverse axis parallel to and spaced from the first transverse axis. The latch member is selectively rotatable relative to the latch housing about the second transverse axis, between a locked position and an unlocked position, via sliding the latch yoke relative to the manhole cover.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Various events, such as explosions or flooding, can cause a sudden pressure increase beneath a manhole cover, which can force the manhole cover from its frame. Several manhole cover assemblies have been developed to release pressure buildup from beneath a manhole cover while limiting displacement of the manhole cover relative to its frame. For example, some manhole cover assemblies include legs or other features to permit limited displacement of the manhole cover. During a pressure-inducing event, the legs contact a bottom surface of the frame, thereby limiting travel of the manhole cover. However, the kinetic energy of the rising manhole cover is concentrated into relatively small areas of the frame surface that are contacted by the legs. Accordingly, significant pressure-inducing events, such as explosions or floods, may damage the frame. This is undesirable because the frame is typically cemented or otherwise permanently fixed in a street or roadway, and removal and replacement of the frame is a significant and costly undertaking.

In addition, manhole covers must be removed from time to time to access the space between the manhole (e.g., a utility vault) to perform inspections, maintenance, repairs, etc. However, manhole covers are also an attractive target for vandals and scavengers due to their relatively substantial value as scrap metal, as well as the value of items housed beneath the manhole cover (e.g., copper wire and other valuable equipment).

Figure 1:
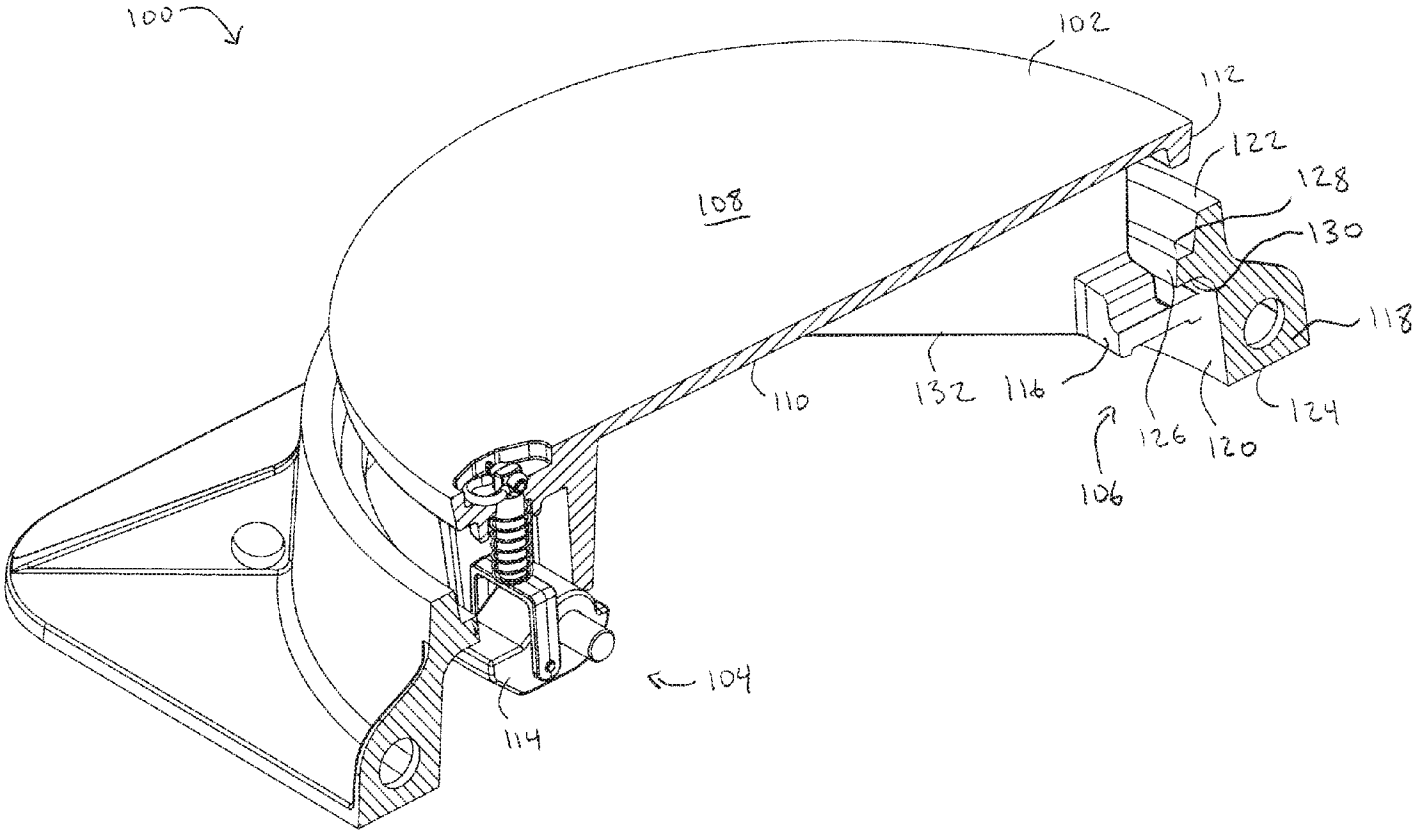
FIG. 1 is a cross-sectional perspective view of a manhole cover assembly, according to an embodiment.

FIG. 1 is a cross-sectional perspective view of a manhole cover assembly 100, according to an embodiment. It should be noted that for clarity and brevity, embodiments are described herein as relating to manhole cover assemblies. However, embodiments described herein may also be utilized in conjunction with hatch covers or other types of covers. As shown in FIG. 1 the manhole cover assembly 100 includes a manhole cover 102, a latch assembly 104, and a lug assembly 106. The manhole cover 102 is generally disc-shaped, having a top surface 108, a bottom surface 110 and an outer periphery 112. The latch assembly 104 and the lug assembly 106 are each securely coupled (e.g., bolted, welded, etc.) to the bottom surface 110 of the manhole cover 102. The latch assembly 104 includes a latch 114 extending radially outward from the latch assembly 104. Similarly, the lug assembly 106 includes a lug 116 extending radially outward from the lug assembly 106.

A frame 118 is configured to support the manhole cover 102 over the opening of a manhole (not shown). The frame 118 is fixedly secured (e.g., cemented or otherwise fixed) within a substrate (e.g., street, road, sidewalk, etc.) defining the opening of the manhole (not shown). The frame 118 is generally ring-shaped, having a peripheral wall 120 extending between an upper surface 122 and an opposite lower surface 124. The peripheral wall 120 has an inner diameter that is slightly larger than an outer diameter of the manhole cover 102. In operation, the upper surface 122 of the frame 118 is generally flush with the road or other surface that defines the manhole.

Figure 4:
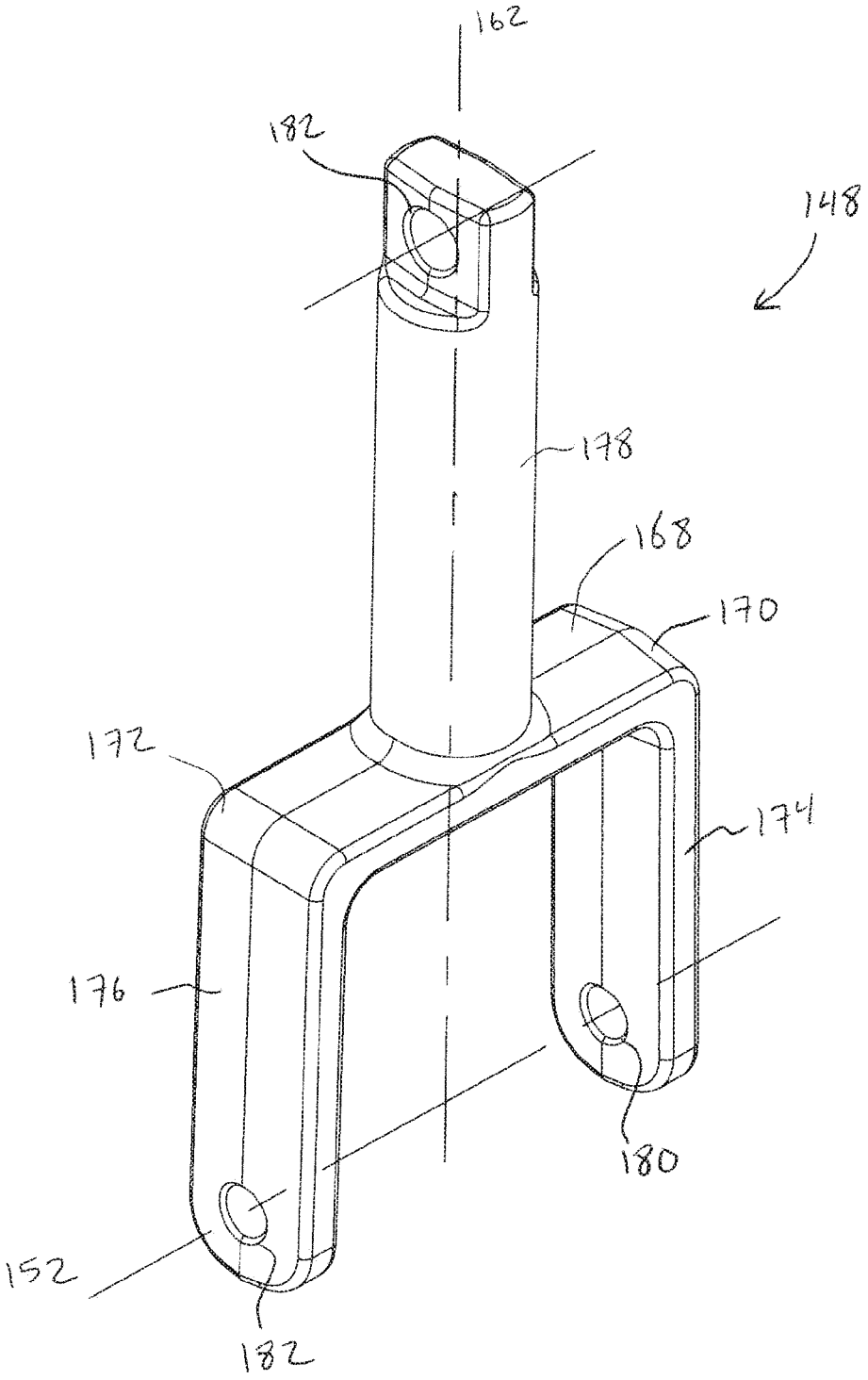
FIG. 4 is a top perspective view of the latch yoke of FIG. 3.

The frame 118 also includes a projection 126 that extends radially inward from the peripheral wall 120. The projection 126 defines a seat 128 facing longitudinally outward toward the upper surface 122, and defines a catch 130 facing longitudinally inward toward the lower surface 124. The seat 128 is structured to support the manhole cover 102 within the frame 118. More specifically, the bottom surface 110 of the manhole cover 102 proximate the outer periphery 112 rests on, and is supported by, the seat 128 when the manhole cover is in a seated position (FIG. 4). The top surface 108 of the manhole cover 102 is generally flush with the upper surface 122 of the frame 118 when the manhole cover 102 is in the seated position. The catch 130 is structured to be engaged by the each of the latch 114 and the lug 116 during a pressure-inducing event so as to retain the manhole cover 102, while controllably dissipating pressure from within the manhole.

Figure 2:
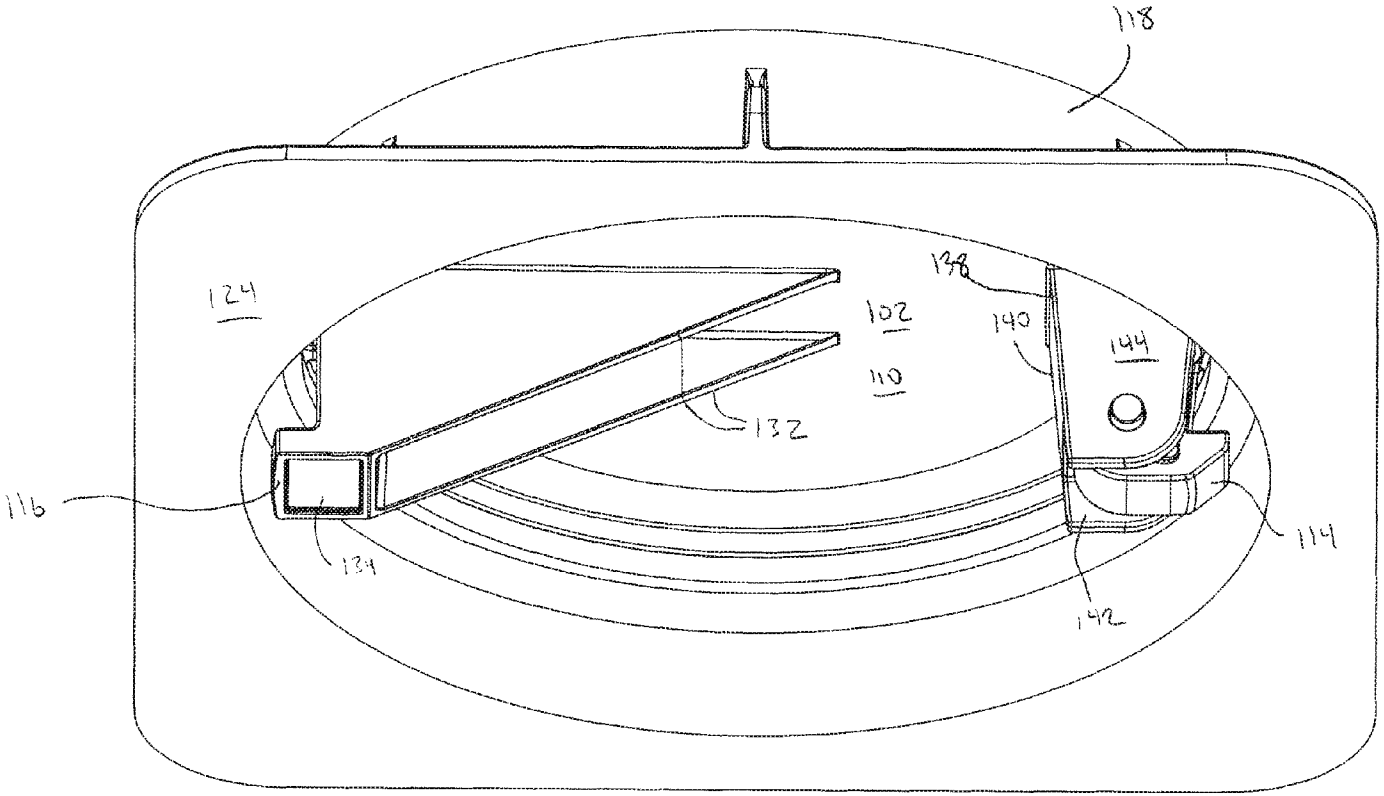
FIG. 2 is a bottom perspective view of the manhole cover assembly of FIG. 1, with the manhole cover in the seated position.

FIG. 2 is a bottom perspective view of the manhole cover assembly 100 of FIG. 1, with the manhole cover 102 in the seated position. As shown in FIG. 2, when the manhole cover 102 is in the seated position, as is typically the case, there is a gap between the catch 130 and each of the latch 114 and the lug 116. A sudden pressure increase against the bottom surface 110 of the manhole cover 102 can cause the manhole cover 102 to move relative to the frame 118 from the seated position (e.g., as shown in FIG. 2) to the unseated position (e.g., as shown in FIG. 1). Returning to FIG. 1, it can be seen that in the unseated position, the latch 114 and the lug 116 each contact the catch 130. Accordingly, the latch and lug assemblies 104, 106 are configured to limit displacement of the manhole cover 102 during a pressure-inducing event in which the manhole cover 102 is forced to the unseated position.

The latch and lug assemblies 104, 106 are also configured to controllably dissipate pressure from within the manhole during a pressure-inducing event. As discussed in further detail below, the latch and lug assemblies 104, 106 permit the energy from a pressure-inducing event (e.g., an explosion or flood) to move the manhole cover 102 from the seated position to the unseated position. When in the unseated position, high-pressure fluid (e.g., air or water) and debris may escape from the manhole through the space then available between the manhole cover 102 and the frame 118, proximate the outer periphery 112 of the manhole cover 102 and the projection 126 of the frame 118. Thus, in response to a pressure-inducing event, the latch and lug assemblies 104, 106 of the manhole cover assembly 100 operate to controllably release pressure from within a manhole rather than allowing the pressure to build up beneath the manhole cover 102 to a potentially dangerous level. In doing so, the latch and lug assemblies 104, 106 prevent the manhole cover 102 from being launched from the frame 118 by a pressure-inducing event, while also preventing damage to the frame 118 and the surface (e.g., street) to which the frame is secured.

The manhole cover assembly 100 also includes extractor rails 132 fixedly coupled (e.g., welded) to each of the manhole cover 102 and the lug assembly 106 so as to form a gradual ramp from the lug 116 to the bottom surface 110 of the manhole cover 102. The extractor rails 132 facilitate easy removal of the manhole cover 102 from the frame 118. In particular, as the manhole cover 102 is pulled away from the frame 118, extractor rails 132 slide against the upper surface 122 of the peripheral wall 120 of the frame 118.

Figure 3:
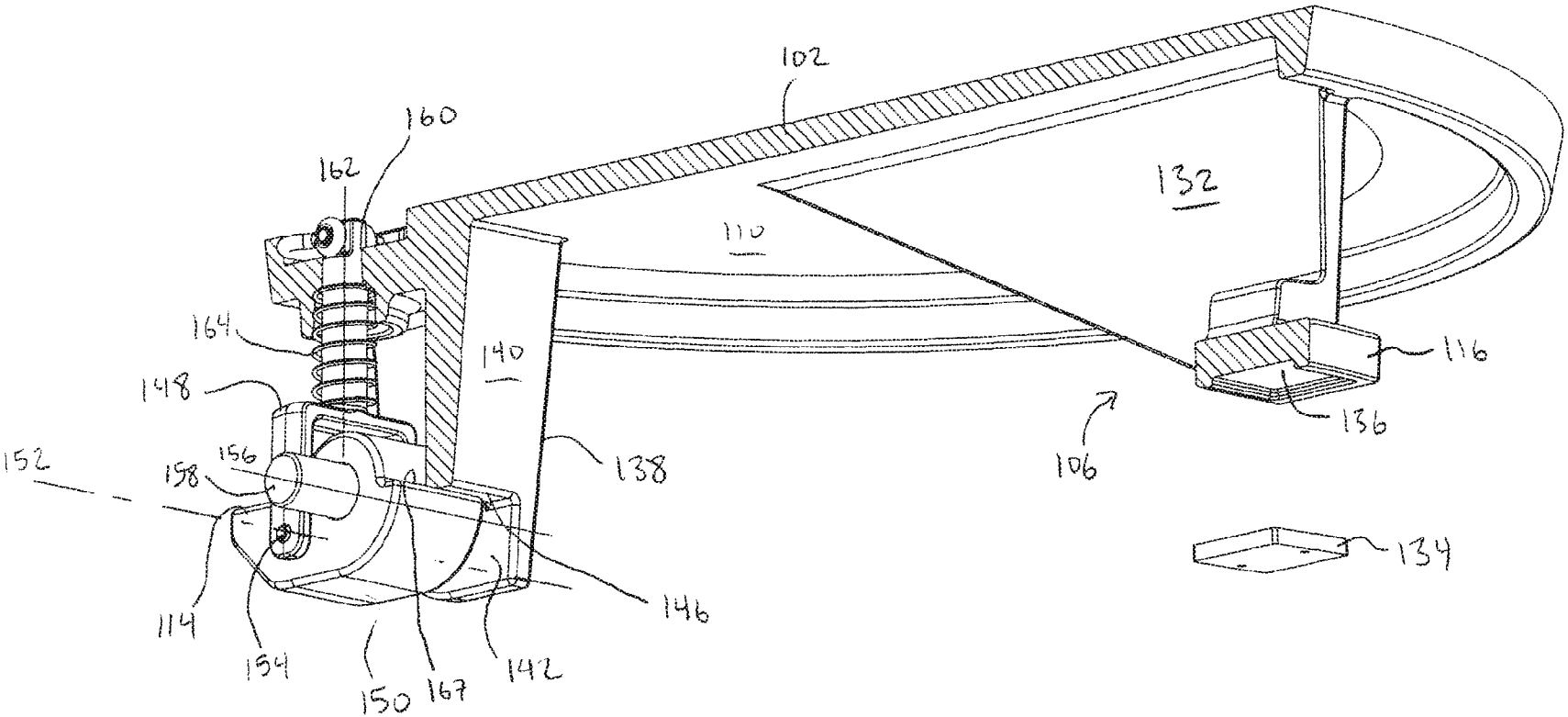
FIG. 3 another cross-sectional perspective view of the manhole cover assembly of FIGS. 1 and 2.

FIG. 3 is another cross-sectional perspective view of the manhole cover assembly 100 of FIGS. 1 and 2. As illustrated in FIG. 3, the lug assembly 106 may further include a skid pad 134 affixed (e.g., bolted) to a bottom surface 136 of the lug 116. The skid pad 134 is configured to support the manhole cover 102 against a surface (e.g., a roadway) upon the manhole cover 102 being removed from the frame 118. According to various embodiments, the skid pad 134 may be formed of high molecular weight polyethylene (HMWP), Teflon, rubber, or other materials.

As further illustrated in FIG. 3, the manhole cover 102 defines a latch housing 138 that extends from the bottom surface 110 of the manhole cover 102. In one embodiment, as shown in FIGS. 2 and 3, the latch housing 138 includes an inner wall 140, a first lateral wall 142 (FIG. 3), and a second lateral wall 144 (FIG. 2), which together form the latch housing 138. The first and second lateral walls 142, 144 extend further from the bottom surface 110 than the inner wall 140. The distal surface of the inner wall 140 defines a catch 146. In one embodiment, the inner wall 140 and the first and second lateral walls 142, 144 are formed of metal (e.g., steel, iron, aluminum, any alloys thereof, etc.) plates or sheet metal, which are welded together to form the latch housing 138. In other embodiments, the inner wall 140 and the first and second lateral walls 142, 144 are formed of cast metal (e.g., steel, iron, aluminum, any alloys thereof, etc.), stamped sheet metal (e.g., steel or aluminum), and injection molded polymer to form the latch housing 138.

The latch assembly 104 includes a latch yoke 148 positioned at least partially within the latch housing 138. A latch member 150 is rotatably coupled to latch yoke 148 relative to a first transverse axis 152 via a yoke pin 154. The latch member 150 is also rotatably coupled to the latch housing 138 relative to a second transverse axis 156 via a pivot pin 158. The second transverse axis 156 is spaced from the first transverse axis 152. The latch yoke 148 extends through a latch bore 160 defined by the manhole cover 102 along a longitudinal axis 162. The latch yoke 148 is slidably coupled to the manhole cover 102 along the longitudinal axis 162 via the latch bore 160. A latch spring 164 is positioned within the latch housing 138 coaxial to the longitudinal axis 162. When assembled, the latch spring 164 is compressed between the latch yoke 148 and the bottom surface 110 of the manhole cover 102. A clevis 166 is coupled to the latch yoke 148 opposite the latch member 150 at a portion of the latch yoke 148 extending through the latch bore 160 so as to retain the latch yoke 148 with the manhole cover 102. In other embodiments, a lift ring or other fastener is utilized instead of the clevis 166.

The latch member 150 is selectively rotatable relative to the latch housing 138 about the second transverse axis 156, between a locked position and an unlocked position, via raising or lowering the latch yoke 148 relative to the manhole cover. The latch member 150 defines the latch 114, and also defines a stop 167 opposite the latch 114. Each of the latch 114 and the stop 167 define planar surfaces structured to engage an obstacle so as to restrict movement of the latch member 150. In the locked position, the latch 114 extends radially outward relative to the manhole cover 102. In the unlocked position, the latch 114 extends radially upward relative to the manhole cover 102.

FIG. 4 is a top perspective view of the latch yoke 148 of FIG. 3. The latch yoke 148 includes a yoke base 168 having first and second ends 170, 172. First and second yoke arms 174, 176 extend perpendicular to the yoke base 168 from the respective first and second ends 170, 172 of the yoke base 168. A yoke shaft 178 extends along the longitudinal axis 162 (FIG. 3) perpendicular to the yoke base 168 opposite the first and second ends 174, 176. The yoke shaft 178 is centered between the first and second ends 174, 176 of the yoke base 168. The first and second yolk arms 174, 176 define respective first and second yoke pin bores 154. The first and second yoke pin bores 154 are coaxial to the first transverse axis 152 (FIG. 3), and are structured to receive the yoke pin 154 (FIG. 3). The yoke shaft 178 defines a clevis bore 182 opposite the yoke base 168, and extending along a third transverse axis 184, which may be parallel to the first and second transverse axes 152, 156. The clevis bore 182 is structured to receive the clevis 166 or lift ring, which is used to raise the latch 114 to the unlocked position.

Figure 5:
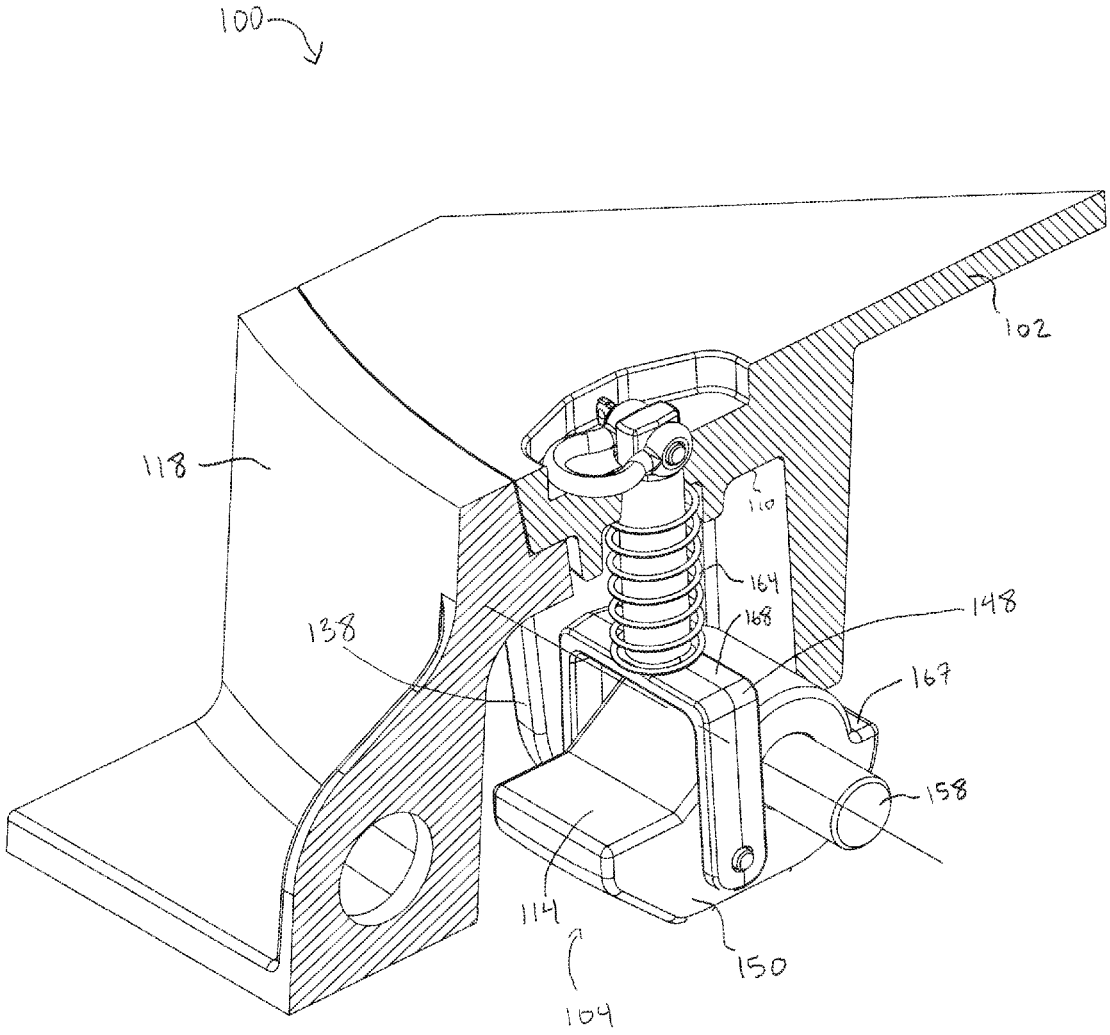
FIG. 5 is a partial cross-sectional perspective view of the manhole cover assembly of FIGS. 1-3, with the manhole cover in the seated position against the frame, and the latch assembly in the locked position.

FIG. 5 is a partial cross-sectional perspective view of the manhole cover assembly 100 of FIGS. 1-3, with the manhole cover 102 in the seated position against the frame 118, and the latch assembly 104 in the locked position. Specifically, the latch assembly 104 is in the locked position because the yoke 148 is fully extended relative to the manhole cover 102. FIG. 5 illustrates the typical configuration of a manhole cover assembly 100 in operation. In this configuration, the latch spring 164 is compressed between the bottom surface 110 of the manhole cover 102 and the yoke 148, specifically the yoke base 168 of the yoke 148. Because the pivot pin 158 is translationally fixed relative to the latch housing 138, the force from the latch spring 164 attempts to rotate the latch member 150 so as to rotate the latch 114 of the latch member 150 downwards. The stop 167 of the latch member 150 engages the catch 146 defined by the inner wall 140 of the latch housing 138 so as to restrict further rotation of the latch member 150. Accordingly, the latch assembly 104 retains the latch member 150 in the locked position while the yoke 148 is fully extended relative to the manhole cover 102.

Returning briefly to FIG. 1, the latch assembly 104 is shown in the locked position with the manhole cover 102 in an unseated position relative to the frame 118, for example, in response to a pressure-inducing event. As shown in FIG. 1, the latch 114 of the latch assembly 104 engages the catch 130 of the frame 118, in conjunction with the lug 116, so as to prevent the manhole cover 102 from being launched from the frame 118. It should be noted that the latch assembly 104 is structured such that pressure-inducing events do not force the yoke 148 of the latch assembly 104 upwards faster than the manhole cover 102 is forced upwards relative to the frame 118. Accordingly, pressure-inducing events do not operate to unlock the latch assembly 104.

Figure 6:
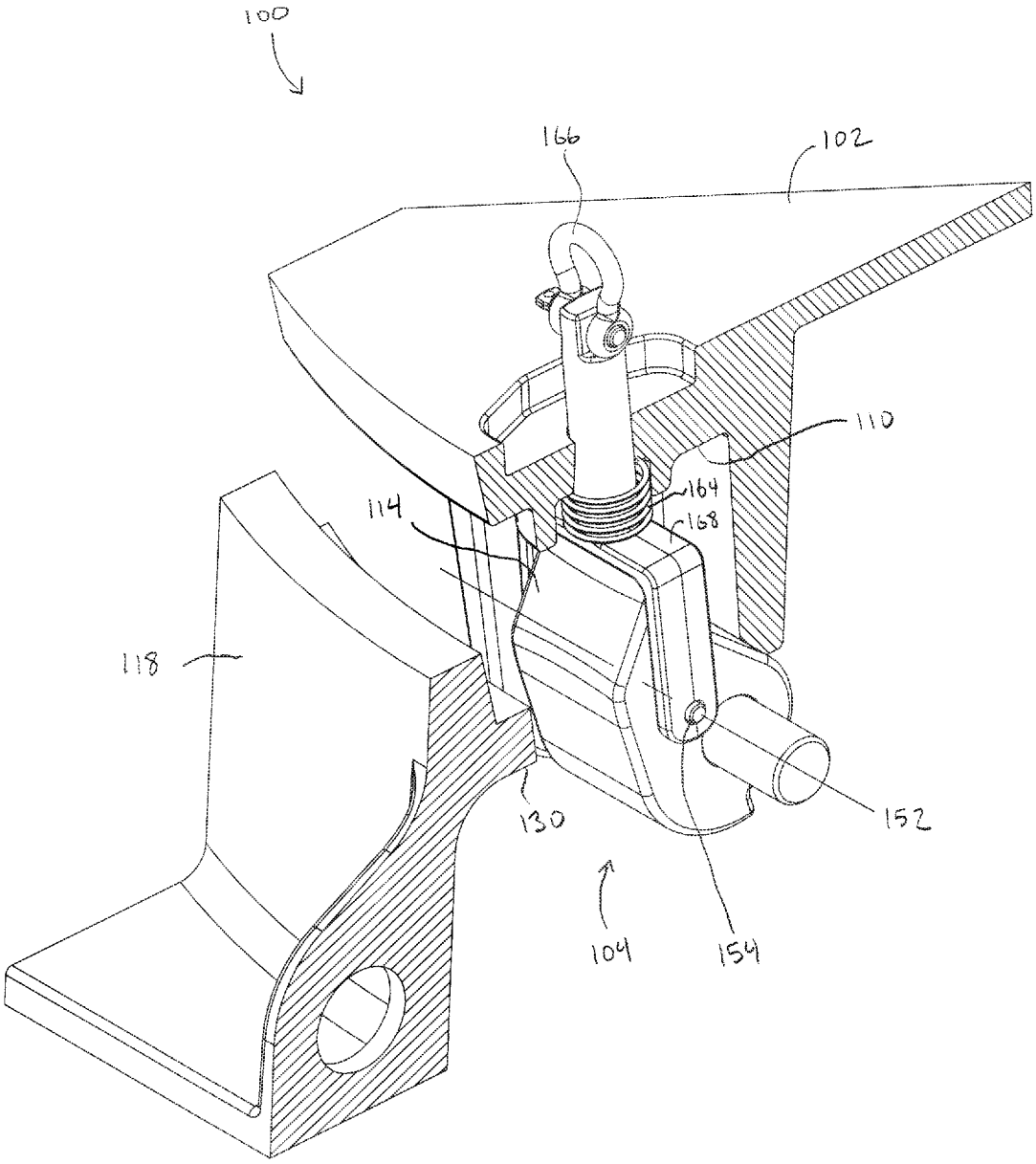
FIG. 6 is a partial cross-sectional perspective view of the manhole cover assembly of FIGS. 1-3 and 5 showing the latch assembly in the unlocked position and the manhole cover displaced from the frame.

FIG. 6 is a partial cross-sectional perspective view of the manhole cover assembly 100 of FIGS. 1-3 and 5 showing the latch assembly 104 in the unlocked position and the manhole cover 102 displaced from the frame 118. When it is the intention to remove the manhole cover 102 for service or inspection, the clevis 166 or lift ring is raised with a lifting hook (not shown), thereby raising the latch yoke 148 relative to the manhole cover 102 and compressing the latch spring 164. The yoke pin 154 in turn lifts and rotates the latch 114 relative to the first transverse axis 152, thereby raising the latch 114 to a position sufficient to allow the latch 114 to clear the catch 130 of the frame 118. Upon releasing the clevis 166, the latch spring 164 applies pressure between the bottom surface 110 of the manhole cover 102 and the yoke base 168 of the latch yoke 148, thereby inducing the latch yoke 148 and the latch 114 to return to the closed and locked position. When the manhole cover 102 is being placed back into the frame 118, the latch 114 contacts the seat 128 of the frame 118, thereby rotating the latch 114 upwards and compressing the latch spring 164 so as to enable the latch 114 to pass by the seat 128 and catch 130, and allow the manhole cover 102 to return to the normal seated position resting against the seat 128. Upon clearing the catch 130, the latch spring 164 extends to its normal position, maintaining the latch assembly 104 in the closed and locked position.

In order to remove the manhole cover 102 from the frame 118, the latch assembly 104 is first unlocked as described above. The manhole cover 102 is pulled away from the frame 118, and extractor rails 132 (FIG. 1) formed on the bottom surface 110 of the manhole cover 102 slide against the upper surface 122 of the peripheral wall 120 of the frame 118 As the manhole cover 102 is completely removed from the frame 118, the manhole cover 102 is supported on the skid pad 134 against the outer surface (e.g., roadway).

Figure 7:
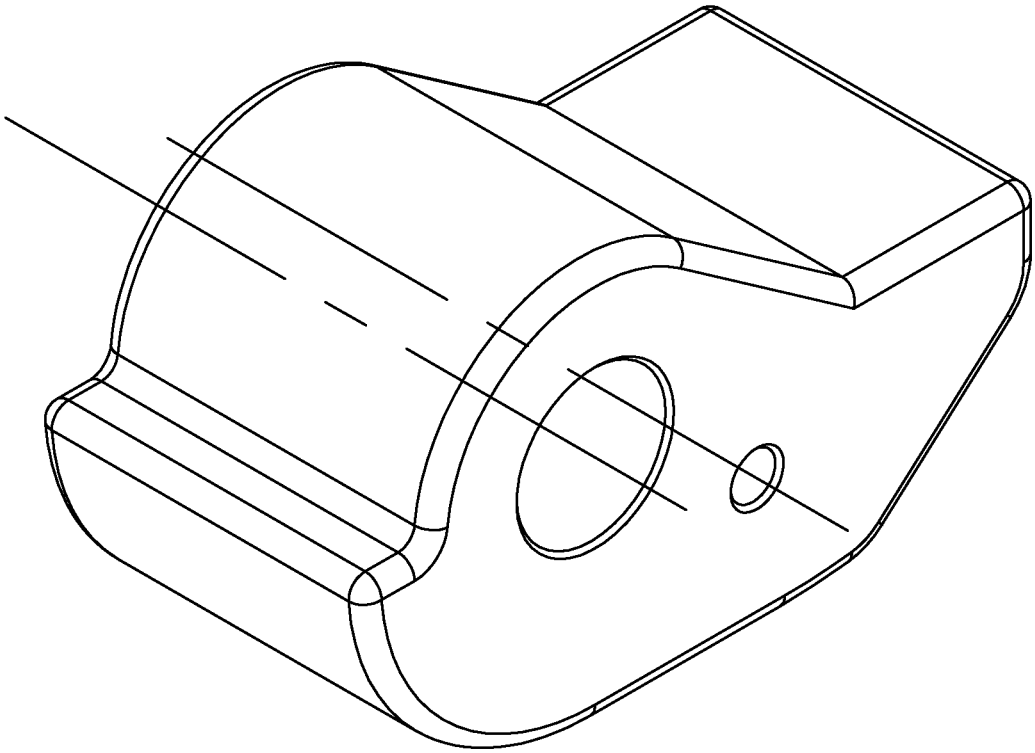
FIG. 7 is a perspective view of the latch member of the manhole cover assembly of FIGS. 1-3 and 5-6.

FIG. 7 is a perspective view of the latch member 150 of the manhole cover assembly 100 of FIGS. 1-3 and 5-6.

While this specification contains many specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and any similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided unless otherwise noted. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled" and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. When the language "at least a portion" and/or "a portion" is used the item can include a portion and/or the entire item unless specifically stated to the contrary.

What is claimed is:

1. A manhole cover assembly, comprising:

a manhole cover supportable by a manhole frame, the manhole cover defining a latch bore having a longitudinal axis;

a latch housing extending from a face of the manhole cover, and a latch assembly positioned at least partially within the latch housing, the latch assembly including:

a latch yoke having a first end and an opposite second end, the first end extending through the latch bore and slidably coupling the latch yoke to the manhole cover along the longitudinal axis, and a latch member defining a latch, the latch member rotatably coupled to the second end of the latch yoke about a first transverse axis, the first transverse axis being perpendicular to the longitudinal axis, the latch member also being rotatably coupled to the latch housing about a second transverse axis, the second transverse axis being parallel to and spaced from the first transverse axis, wherein the latch member is selectively rotatable relative to the latch housing about the second transverse axis between a locked position and an unlocked position via slidable movement of the latch yoke relative to the manhole cover, wherein the manhole cover is prevented from being removed from the frame when the latch member is in the locked position, wherein the manhole cover is movable between a seated position in which the manhole cover is supported on the manhole frame, and an unseated position in which the manhole cover is displaced relative to the manhole frame, and wherein, in response to a pressure applied to the manhole cover, the latch assembly is configured to permit limited displacement of the manhole cover relative to the manhole frame, and to controllably dissipate energy relating to the pressure.

2. The manhole cover assembly of claim 1, wherein the latch is structured to engage the manhole frame when the latch member is in the locked position so as to prevent the manhole cover from being removed from the frame, and to disengage the manhole frame when the latch member is in the unlocked position so as to enable the manhole cover to be removed from the frame.

3. The manhole cover assembly of claim 1, further comprising:

a lug assembly coupled to the manhole cover and comprising a lug extending radially outward from the lug assembly, wherein the lug is structured to engage a catch defined by the seat of the manhole frame.

4. The manhole cover assembly of claim 1, further comprising a latch spring coaxial to the longitudinal axis, the latch spring configured to be compressed between the latch yoke and a lower surface of the manhole cover.

5. The manhole cover assembly of claim 4, wherein when the manhole cover is being placed on the manhole frame, the latch member is configured to engage the frame, such that the latch member rotates upward about the second transverse axis, compressing the latch spring.

6. The manhole cover assembly of claim 5, wherein when the latch member is positioned below a catch, the latch spring configured to decompress, such that the latch member rotates downward about the second transverse axis into the locked position.

7. The latch assembly of claim 6, wherein in the locked position, the latch member extends radially outward relative to the manhole cover.

8. The manhole cover assembly of claim 1, wherein the latch housing further comprises an inner wall defining a catch at a distal end thereof, and wherein the latch member defines a stop configured to engage the catch of the inner wall.

* * * * *